US005158513A

United States Patent [19]

Reeves

[11] Patent Number: 5,158,513

[45] Date of Patent: Oct. 27, 1992

[54] SWIMMING EXERCISE AND TRAINING APPARATUS

[76] Inventor: Michael P. Reeves, 217 Garfield Ave., Avon, N.J. 07717

[21] Appl. No.: 758,575

[22] Filed: Sep. 12, 1991

[51] Int. Cl.[5] ..... A63B 69/10

[52] U.S. Cl. ..... 482/56; 482/142; 434/254

[58] Field of Search ..... 272/71, 144; 128/70, 128/74; 482/55, 56, 142, 143, 145; 434/254

[56] References Cited

U.S. PATENT DOCUMENTS

| | | | |
|---|---|---|---|
| 326,247 | 9/1885 | Root | 482/56 |
| 2,033,275 | 3/1936 | Campbell | 482/56 |
| 4,674,740 | 6/1987 | Iams et al. | 482/56 |
| 4,830,363 | 5/1989 | Kennedy | 482/56 |

*Primary Examiner*—Richard J. Apley
*Assistant Examiner*—Lynne Reichard

[57] ABSTRACT

The swimming exercise and training apparatus comprises a base arrangement disposed on a supporting surface for the apparatus; a support member having a longitudinal axis secured in line with and in a substantially horizontal position to the base arrangement in a spaced relationship thereabove; a head support for a user's head secured to a first portion of the support member capable of independent rotation about the longitudinal axis; a chest support for the user's chest secured to a second portion of the support member spaced from the head support capable of independent rotation about the longitudinal axis; a hip support for the user's hips secured to a third portion of the support member spaced from the chest support capable of independent rotation about the longitudinal axis; a leg support for the user's legs pivotally secured to a fourth portion of the support member spaced from the hip support to enable the user to simulate swimming leg movements; and an arrangement secured to the base arrangement gripped by the user's hands to enable the user to simulate swimming arm movements; the independent rotation of the head support, chest support and hip support enabling the user's body to rotate as it would if the leg and arm movements were carried out in water.

20 Claims, 2 Drawing Sheets

SWIMMING EXERCISE AND TRAINING APPARATUS

BACKGROUND OF THE INVENTION

The present invention relates to exercise apparatus and more particularly to an improved swimming exercise and training apparatus.

Sport physiologists agree that doing the actual exercise is the most beneficial way to train; that is, runners should run, cyclists should cycle and swimmers should swim.

Swimming is the most efficient and least injurious exercise form presently available. It is highly desirable in that it provides exercise to practically all muscle groups within the body. In another aspect, it is highly aerobic and able to provide a highly desirable cardiovascular exercise regime to a user without the risk of localized injuries found in other modes of exercise. It is more rapidly accomplished than brisk walking. Swimming is susceptible to fewer injuries than the more stressful exercise of jogging or running with the proportionate risk of knee or ankle injury as a result of pounding during running. Swimming additionally is more aptly effective throughout the body as opposed to bicycle riding which is primarily exercise of the legs. In all regards, swimming is more desirable in that it provides a higher and more distributed aerobic load to the user with reduced localized impact, and is desirable from all points of view for these factors. Swimming, however, requires physical competency and to some measure requires endurance training. Once the requisite skill has been developed by the user, then some measure of self-satisfaction can be achieved by the user in performing swimming strokes with a reasonable stroke efficiency.

Swimming exercise and training apparatus enabling a user to exercise and/or train outside a pool or other body of water are known in the prior art as represented by U.S. Pat. Nos. 4,830,363 and 4,844,450 and the various U.S. patents referred to in these two patents. The prior art swimming exercise and training apparatus enable the user to perfect leg kicks and arm movements or strokes, but fail to provide an arrangement to enable the user to at least approximate the rolling motion made by the body of the user during leg kicks and arm strokes as would normally occur in water. The rolling motion of the body cannot be approximated in the prior art apparatus, since the body of the user from the hips to the head are support on a solid board or boards which are rotationally fixed in position.

SUMMARY OF THE INVENTION

An object of the present invention is to provide an improved swimming exercise and training apparatus.

Another object of the present invention is to provide an improved swimming exercise and training apparatus enabling the user thereof to approximate the rolling motion of the body of the user during leg kicks and arm strokes as would normally occur in water.

Still another object of the present invention is to provide an improved swimming exercise and training apparatus enabling the user thereof to approximate the rolling motion of the body of the user during leg kicks and arm strokes as would normally occur in water so the user can perfect leg kicks, arm strokes, breathing coordinated with the leg kicks and arm strokes and other swim specific activities without the need to concentrate on staying afloat as well.

A feature of the present invention is the provision of a swimming exercise and training apparatus comprising base means disposed on a supporting surface for the apparatus; support means having a longitudinal axis secured in line with and in a substantially horizontal position to the base means in a space relationship thereabove; first means to support a user's head secured to a first portion of the support means capable of rotation about the longitudinal axis; second means to support the user's chest secured to a second portion of the support means spaced from the first means capable of rotation about the longitudinal axis; third means to support the user's hips secured to a third portion of the support means spaced from the second means capable of rotation about the longitudinal axis; fourth means to support the user's legs pivotally secured to a fourth portion of the support means spaced from the third means to enable the user to simulate swimming leg movements; and fifth means secured to the base means gripped by the user's hands to enable the user to simulate swimming arm movements; the independent rotation of the first, second and third means enabling the user's body to rotate as it would if the leg and arm movements were carried out in water.

Another feature of the present invention is the provision of a swimming exercise and training apparatus as described immediately above wherein the support means includes sixth means to enable adjustment of the distance between the first and second means, the distance between the second and third means and the distance between the fourth and third means to accomodate different height users.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
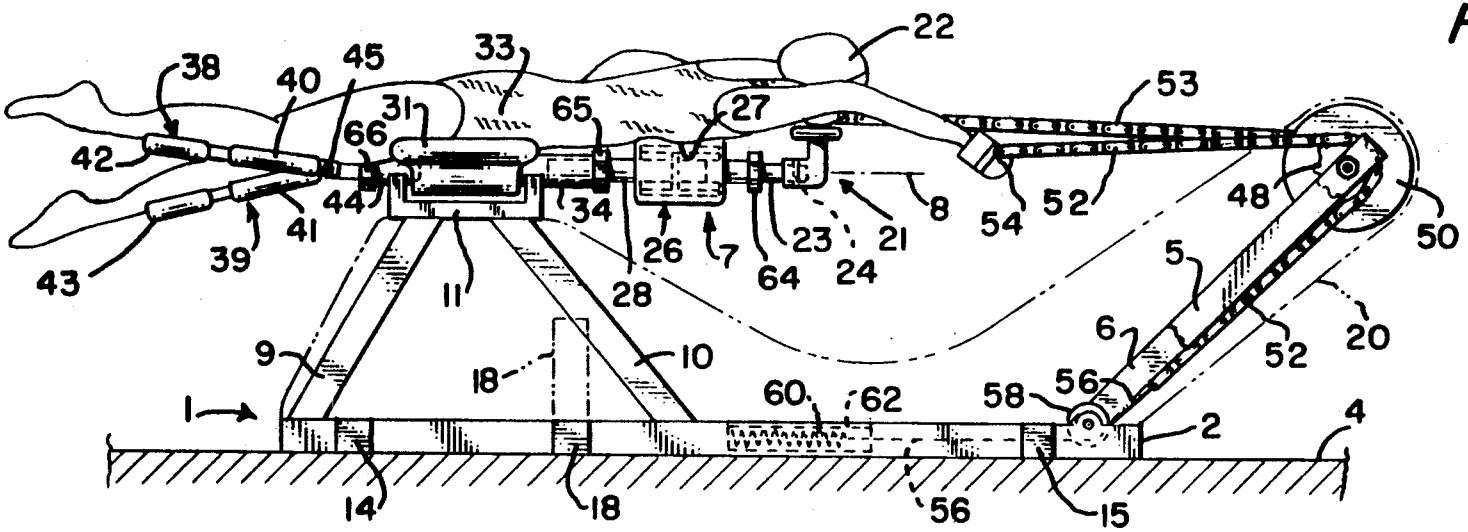
FIG. 1 is a side view of the swimming exercise and training apparatus in accordance with the principles of the present invention with a cover removed and a user in one swimming position.
Figure 2:
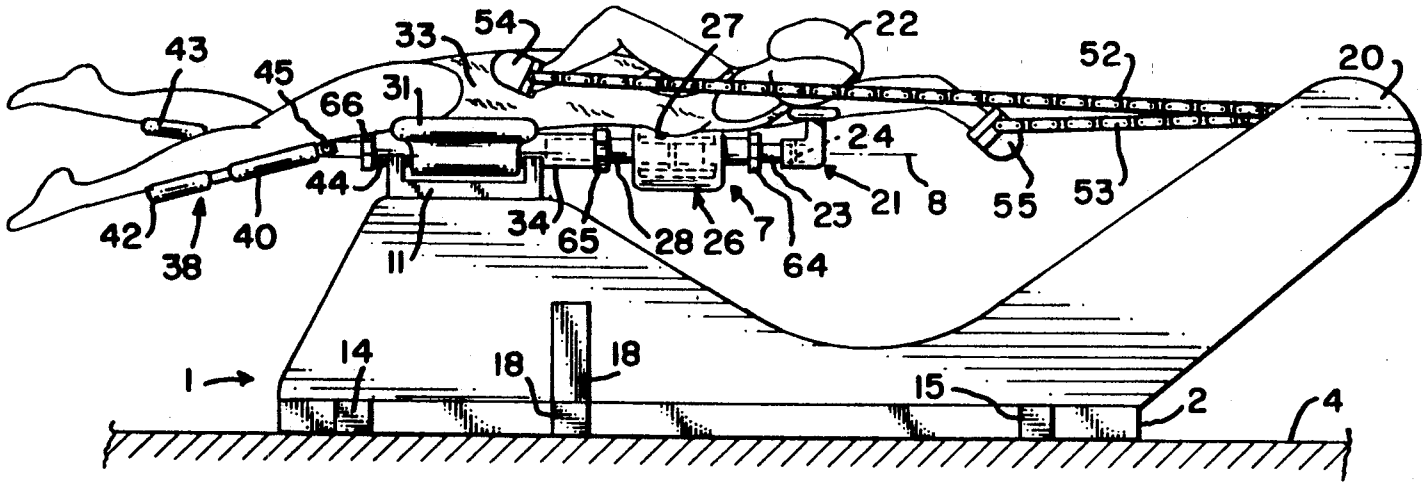
FIG. 2 is a side view of the swimming exercise and training apparatus in accordance with the principles of the present invention with the cover in place and the user in another swimming position.
Figure 3:
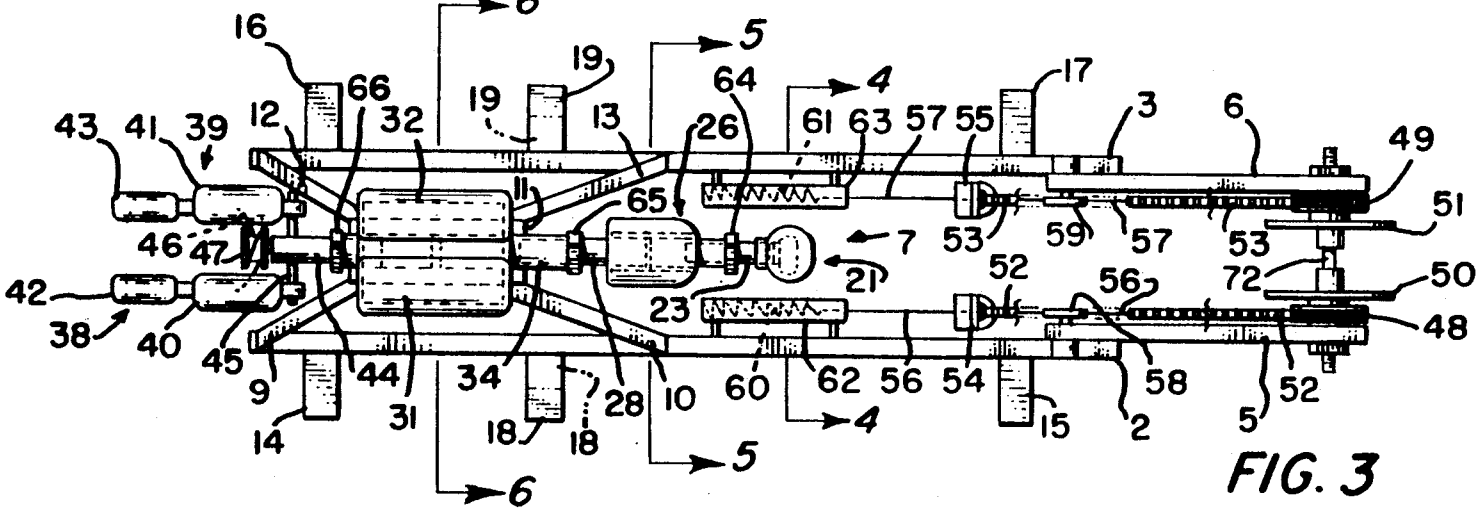
FIG. 3 is a top view of the apparatus of FIGS. 1 and 2 with the user and cover removed.

Referring to FIGS. 1, 2 and 3, the swimming exercise and training apparatus of the present invention includes base means 1 including members 2 and 3 resting on a supporting surface 4 for the apparatus and members 5 and 6 extending upward from members 2 and 3, respectively, to support other components of the apparatus to be described later. The apparatus of the present invention further includes support means 7 having a longitudinal axis 8 and is secured in line with and in a substantially horizontal position to base means 1 by members 9 and 10 secured to member 2 and yoke-like member 11 and members 12 and 13 secured to member 3 and yoke-member 11. The apparatus of the present invention is stabilized by outriggers 14 and 15 secured to member 2, outriggers 16 and 17 secured to member 3 and outriggers 18 and 19 secured to members 2 and 3, respectively, and cover 20.

Figure 4:
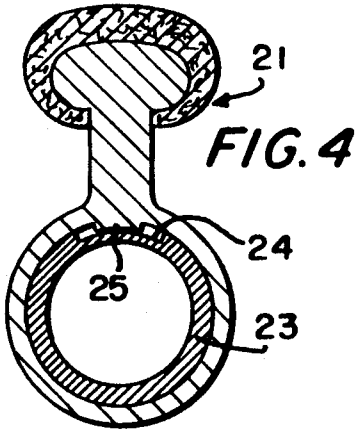
FIG. 4 is a cross-sectional view taken along line 4—4 of FIG. 3.

A padded member 21 to support the user's head 22 is secured to a first portion 23 of support means 7 in a manner to enable rotation of member 21 about axis 8. As shown in FIG. 4 this is accomplished by providing a groove 24 in portion 23 and a projection 25 on member 21 extending into groove 24. This arrangement prevents longitudinal movement of member 21 along axis 8, but enables member 21 to rotate about axis 8 as the user rotates its head to simulate breathing during swimming.

Figure 5:
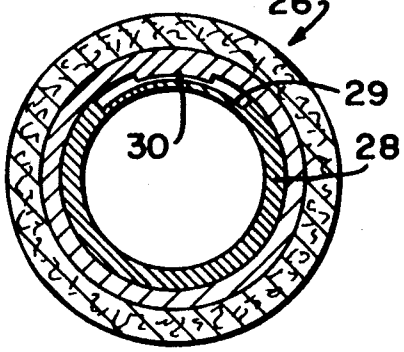
FIG. 5 is a cross-sectional view taken along line 5—5 of FIG. 3.

A padded member 26, preferrably cylindrical in shape, to support the user's chest 27 is secured to a second portion 28 of support means 7 in a manner to enable rotation of member 26 about axis 8. As shown in FIG. 5 this is accomplished by providing a groove 29 in portion 28 and a projection 30 on member 26 extending into groove 29. This arrangement prevents longitudinal movement of member 26 along axis 8, but enables member 26 to rotate about axis 8 as the user's body rotates during swimming arm strokes or movements.

Figure 6:
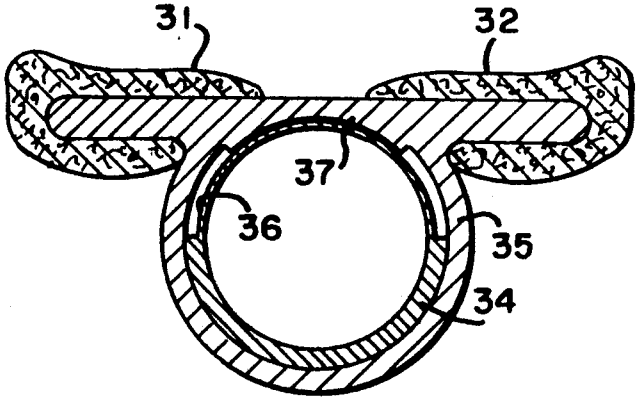
FIG. 6 is a cross-sectional view taken along line 6—6 of FIG. 3.

Padded members 31 and 32 to support the user's hips 33 with anatomical comfort is secured to a third portion 34 of support means 7 in a manner to enable rotation of members 31 and 32 with respect to axis 8. As shown in FIG. 6 this is accomplished by interconnecting members 31 and 32 by means of member 35 encircling portion 34. Portion 34 has a groove 36 therein which receives therein projection 37 on member 35. This arrangement prevents longitudinal movement of members 31 and 32 parallel to axis 8, but enables members 31 and 32 to rotate with respect to axis 8 in a tetter totter like motion as the user's body rotates during swimming arm strokes and leg kicks.

Leg support members 38 and 39, one for each of the user's legs, includes thigh support members 40 and 41, respectively, and shin support members 42 and 43, respectively, as best shown in FIG. 3. Members 38 and 39 are pivotally secured to a fourth portion 44 of support means 7 by pivot member 45. Members 38 and 39 are interconnected by means of a cable-like member 46 looped around pulley 47 secured to the end of portion 44 so that when one of members 38 and 39 is moved downward by one leg of the user the other of members 38 and 39 is moved upward to raise the other leg of the user. This enables the user to simulate leg kicks with a resistance that would normally be present in water.

An arrangement to enable a user to simulate swimming arm movements or strokes is secured to members 2, 3, 5 and 6 of base means 1. This arrangement includes a pair of sprocket wheels 48 and 49 independently driving a pair of flywheels 50 and 51 disposed on a common shaft 52 secured by a nut and bolt arrangement between members 5 and 6 as best shown in FIG. 3. An overrunning clutch device is present between sprocket wheel 48 and flywheel 50 and between sprocket wheel 49 and flywheel 51 so that flywheels 50 and 51 are only driven when a user's arm provides a power stroke to its associated sprocket wheel. Swimming arm movements or strokes are applied to sprocket wheels 48 and 49 by means of bicycle-type chains 52 and 53, respectfully. One end of each of the chains 52 and 53 have hand grips 54 and 55, respectively, to be gripped by the user's hand. The other end of chains 52 and 53 have cables 56 and 57, respectively, attached thereto. Cables 56 and 57 engage pulleys 58 and 59, respectively, and are connected to position restoring means illustrated as being compression springs 60 and 61 whose movements are confined in cylinders 62 and 63. Upon a power stroke of one of the user's arms, the associate one of springs 60 and 61 is compressed. When this one of the user's arms goes through a return stroke, the compressed one of springs 60 and 61 expands thereby pulling the associated one of chains 52 and 53 in to the proper position to be ready for the next power stroke of that one of the user's arms.

While the position restoring means is shown as being a spring that is compressed on a power stroke of a user's arm, it is also possible to employ a spring that expands on a power stroke of a user's arm. When the expanded spring returns to its initial position upon the user's arm going through a return stroke, the associated chain will be returned to the appropriate position to be ready for the next power stroke. Also cables 56 and 57 can be replaced by bungee cords, or cables 56 and 57 can be a combination of solid cables and bungee cords. The bungee cords being able to assist the position restoring means to return the associated chain to the appropriate position prior to the next power stroke.

Support means 7 is designed to enable a user to adjust the distance between members 21, 26, 31 and 32 and 44 to comfortably accommodate different height users. This is accomplished by having portion 23 extend into portion 28, by having portion 28 extend into portion 34 and by having portion 44 extend into portion 34. A locking nut 64 is provided at the end of portion 28 to enable movement of portion 23 with respect to portion 28 to adjust the distance between member 21 and member 26. Once the proper distance is obtained for comfortable support of head and chest nut 64 is tightened to lock portions 23 and 28 together. Similarly, locking nut 65 is provided at one end of portion 34 to enable adjustment of the distance between member 26 and members 31 and 32 and locking nut 66 is provided at the other end of portion 34 to enable adjustment of the distance between members 38 and 39 and members 31 and 32. These adjustments can be made with the user on the apparatus to assure a comfortable support for the user's body.

Members 40, 41, 42, and 43 of the leg support 38 and 39 have a concave configuration to more comfortably receive the thighs and shins of the user's legs.

While I have described above the principles of my invention in connection with specific apparatus, it is to be clearly understood that this description is made only by way of example and not as a limitation to the scope of my invention as set forth in the objects thereof and in the accompanying claims.

I claim:

1. A swimming exercise and training apparatus comprising:

base means disposed on a supporting surface for said apparatus;

support means having a longitudnal axis secured in line with and in a substantially horizontal position to said base means in a spaced relationship thereabove;

first means to support a user's head secured to a first portion of said support means capable of rotation about said longitudnal axis;

second means to support said user's chest secured to a second portion of said support means spaced from and independent of said first means capable of rotation about said longitudnal axis;

third means to support said user's hips secured to a third portion of said support means spaced from and independent of said first means and said second means capable of rotation about said longitudnal axis;

fourth means to support said user's legs pivotably secured to a fourth portion of said support means spaced from said third means to enable said user to simulate swimming leg movements; and fifth means secured to said base means gripped by said user's hands to enable said user to simulate swimming arm movements;

the rotation of said first, second and third means being independent of each other to enable said user's head, chest and hips to rotate independently of each other as they would if said leg and arm movements were carried out in water.

2. Apparatus according to claim 1, wherein said support means includes sixth means to enable adjustment of the distance between said first and second means, the distance between said second and third means and the distance between said fourth and third means to accommodate different height users.

3. Apparatus according to claim 2, wherein said first means includes a padded member secured to said first portion of said support means to prevent longitudinal movement thereof along said longitudinal axis and to enable rotation thereof about said longitudinal axis.

4. Apparatus according to claim 3, wherein said second means includes a second padded member secured to said second portion of said support means to prevent longitudinal movement thereof along said longitudinal axis and to enable rotation thereof about said longitudinal axis.

5. Apparatus according to claim 4, wherein at least said second portion of said support means is cylindrical, and said second padded member is cylindrical and disposed coaxially of and outside said second portion of said support means.

6. Apparatus according to claim 4, wherein said third means includes a pair of padded members each disposed on a different side of said longitudinal axis, and a seventh means interconnecting said pair of padded members, said seventh means being secured to said third portion of said support means to prevent longitudinal movement of said pair of padded members along said longitudinal axis and to enable rotational movement of said pair of padded members in response to rotation of said user's hips.

7. Apparatus according to claim 6, wherein said fourth means includes a pair of leg support means, one for each of said user's legs, pivotally connected to said fourth portion of said support means adjacent the end thereof spaced from said third portion of said support means, each of said pair of leg support means being disposed on a different side of said longitudinal axis, and interconnecting means connected between each of said pair of leg support means and said end of said third portion of said support means to cause one of said pair of leg support means to go up when the other of said pair of leg support means goes down and vice versa in response to said swimming leg movements.

8. Apparatus according to claim 7, wherein said fifth means includes a pair of motion resistance means secured to said base means each driven by a different one of said user's arms to provide said user with a feel of water resistance during said arm movements.

9. Apparatus according to claim 8, wherein each of said pair of motion resistance means includes a sprocket wheel rotated by a bicycle-type chain having one end thereof gripped by one of said user's hands and the other end thereof connected to a position restoring means connected to said base means, and a flywheel means connected to said sprocket wheel through an overrunning clutch means so that said flywheel rotates only on the power stroke of said arm movements, each of said pair of motion resistance means operating independently of each other.

10. Apparatus according to claim 9, wherein said sprocket, said flywheel means and said clutch means of each of said pair of motion resistance means are disposed adjacent opposite ends of a common shaft.

11. Apparatus according to claim 9, wherein said position restoring means includes a selected one of a return spring, a bungee cord and a combination of a return spring and a bungee cord.

12. Apparatus according to claim 1, wherein said first means includes a padded member secured to said first portion of said support means to prevent longitudinal movement thereof along said longitudinal axis and to enable rotation thereof about said longitudinal axis.

13. Apparatus according to claim 12, wherein said second means includes a second padded member secured to said second portion of said support means to prevent longitudinal movement thereof along said longitudinal axis and to enable rotation thereof about said longitudinal axis.

14. Apparatus according to claim 13, wherein at least said second portion of said support means is cylindrical, and said second padded member is cylindrical and disposed coaxially of and outside said second portion of said support means.

15. Apparatus according to claim 13, wherein said third means includes a pair of padded members each disposed on a different side of said longitudinal axis, and a seventh means interconnecting said pair of padded members, said seventh means being secured to said third portion of said support means to prevent longitudinal movement of said pair of padded members along said longitudinal axis and to enable rotational movement of said pair of padded members in response to rotation of said user's hips.

16. Apparatus according to claim 15, wherein said fourth means includes a pair of leg support means, one for each of said user's legs, pivotally connected to said fourth portion of said support means adjacent the end thereof spaced from said third portion of said support means, each of said pair of leg support means being disposed on a different side of said longitudinal axis, and interconnecting means connected between each of said pair of leg support means and said end of said third portion of said support means to cause one of said pair of leg support means to go up when the other of said pair of leg support means goes down and vice versa in response to said swimming leg movements.

17. Apparatus according to claim 16, wherein said fifth means includes a pair of motion resistance means secured to said base means each driven by a different one of said user's arms to provide said user with a feel of water resistance during said arm movements.

18. Apparatus according to claim 17, wherein each of said pair of motion resistance means includes a sprocket wheel rotated by a bicycle-type chain having one end thereof gripped by one of said user's hands and the other end thereof connected to a position restoring means connected to said base means, and a flywheel means connected to said sprocket wheel through an overrunning clutch means so that said flywheel rotates only on the power stroke of said arm movements.

each of said pair of motion resistance means operating independently of each other.

19. Apparatus according to claim 18, wherein said sprocket, said flywheel means and said clutch means of each of said pair of motion resistance means are disposed adjacent opposite ends of a common shaft.

20. Apparatus according to claim 18, wherein said position restoring means includes a selected one of a return spring, a bungee cord and a combination of a return spring and a bungee cord.

* * * * *